United States Patent [19]

Hüttlin

[11] 4,392,777

[45] Jul. 12, 1983

[54] PUMP OR BLOWER, IN PARTICULAR FOR HEATING AND AIR-CONDITIONING SYSTEMS

[76] Inventor: Herbert Hüttlin, Lörracher Strasse 14, D-7853 Steinen, Fed. Rep. of Germany

[21] Appl. No.: 223,989

[22] Filed: Jan. 12, 1981

[30] Foreign Application Priority Data

Jan. 22, 1980 [DE] Fed. Rep. of Germany ..... 3002210

[51] Int. Cl.[3] ..... B23B 47/00

[52] U.S. Cl. ..... 415/131; 415/153 A

[58] Field of Search ..... 415/129, 131, 132, 153 A; 417/62

[56] References Cited

U.S. PATENT DOCUMENTS

| | | | |
|---|---|---|---|
| 1,959,106 | 5/1934 | Messing | 415/131 |
| 2,877,710 | 3/1959 | Barnhart | 415/131 X |
| 3,404,631 | 10/1968 | Nixon | 415/131 X |

FOREIGN PATENT DOCUMENTS

| | | | |
|---|---|---|---|
| 1653896 | 2/1970 | Fed. Rep. of Germany | 415/131 |
| 2107000 | 2/1971 | Fed. Rep. of Germany | 415/131 |
| 2510787 | 8/1975 | Fed. Rep. of Germany | 415/131 |

*Primary Examiner*—Philip R. Coe
*Assistant Examiner*—Frankie L. Stinson
*Attorney, Agent, or Firm*—Eyre, Mann, Lucas & Just

[57] ABSTRACT

A pump or blower device particularly for heating and air conditioning systems is provided with a plurality of inlet ports and a plurality of outlet ports. Axially displaceable impeller means are moved to connect any one inlet port selectively with a first outlet port or with a second different outlet port or with a plurality of outlet ports simultaneously. The device is of great advantage in controlling the circulation of heating or cooling fluids between a primary circuit and secondary circuits that branch out to provided heating or cooling in selected separate areas of a building or to a plurality of buildings serviced by the primary circuit. The present device decreases the number of pumps and mixing valves in the systems and results in decreasing installation and operating costs.

8 Claims, 7 Drawing Figures

PUMP OR BLOWER, IN PARTICULAR FOR HEATING AND AIR-CONDITIONING SYSTEMS

Figure 1:
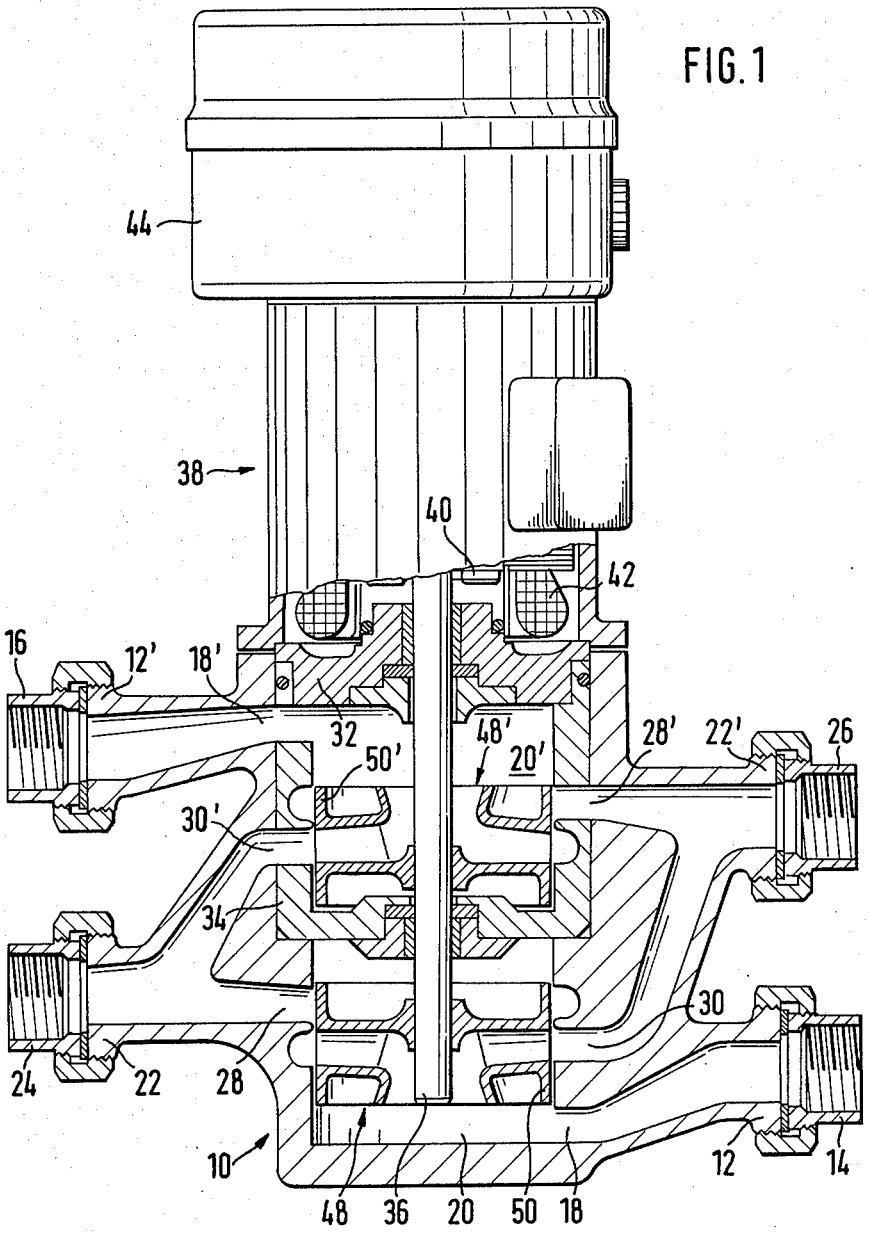

The invention relates to a pump or blower, in particular for heating and air-conditioning systems, comprising an impeller chamber formed inside a casing, said chamber being connected, via ducts staggered in an axial direction in the casing, with a suction stub pipe, as well as with a first and a second pressure stub pipe, and containing a rotatable impeller, said impeller being axially displaceable with respect to the casing between positions in which it produces by its rotation a delivery flow between the suction stub pipe and optionally the first or the second pressure stub pipe.

In the case of heating and air-conditioning systems for sizeable buildings or groups of buildings, a plurality of automatically controllable secondary circuits are frequently connected up, via a multi-way valve in each case, with a primary circuit common to them. The primary circuit usually contains two circulating pumps connected with each other in parallel, alternatively one of these pumps being in operation and the other being shut off at any time. Each of the secondary circuits has its own circulating pump which, depending on the setting of the associated multi-way valve, takes a smaller or larger flow of the heating or cooling medium from the primary circuit and returns it to the latter. The separate multi-way valves and circulating pumps which are installed, entail considerable costs; there are equally numerous possibilities of mistakes being made in installation work. The capacity of the circulating pumps in the primary circuit must be designed to cater for the maximum possible requirement of all secondary circuits; one of these circulating pumps generally runs at full performance, irrespective of how many secondary circuits are in operation and of how big their heating or cooling requirement is. The primary-circuit circulating pump which is running thus uses, on the average, considerably more power to be driven than would be necessary if the flow in the primary circuit were matched to the requirement in the secondary circuits.

A pump of the type described at the beginning is known which is designed as a single-stage centrifugal pump and, as is customary in such pumps, which has a single suction stub pipe and a single impeller. This known pump is designed to be installed in a heating system between a boiler, a flow line leading to heat consumers and a return line coming from the latter. The suction stub pipe of the pump is connected with the return line, the first pressure stub pipe with the boiler and the second pressure stub pipe with a bypass to the flow line. The temperature of the water pumped into the flow line can be controlled by axial displacement of the impeller, because a smaller or larger share of cold return water goes into the flow line as a function of the position of the impeller. Thus, the known pump can replace a multi-way mixing valve and, in so doing, bring down the cost of installing the heating system.

As in the case of a customary heating system having a circulating pump and a three-way mixing valve separate from it, the described pump with axially displaceable impeller is, admittedly, only partially utilised if the impeller, owing to little heat being required by the heat consumers, has such a setting that it returns the heating water from the suction stub pipe, bypassing largely or completely the first pressure stub pip and the boiler, via the second pressure stub pipe to the flow line. In this operating condition, a non-regulatable electric motor provided to drive the pump works with poor efficiency and, additionally, the heating water in the partial circuit supplied by the pump between the latter and the heat consumers flows at excess velocity, a possible source of objectionable noise. On the other hand, the partial circuit not served by the pump between the latter and the boiler cools off, a possible source of difficulties in regulating the temperature of the boiler.

It is an object of the invention to develop a pump of the aforesaid type for a heating, air-conditioning or similar system in such a manner that it works with a substantially uniform, favourable power consumption to drive it and avoids the mentioned troublesome phenomena.

This object is achieved in a pump of the aforesaid type in the invention in that two impeller chambers separated from each other, and each containing one impeller, are each connected via one duct with the first pressure stub pipe, and each via another duct with the second pressure stub pipe, and that the two impellers are jointly displaceable.

With a pump according to the invention, a secondary circuit of a heating or air-conditioning system or of another comparable system can be connected up with a primary circuit in such a manner that the medium they contain, for instance water, flows through the two circuits either separately or consecutively, depending on the position of the two impellers of the pump in the invention; in the former case, the pump in the invention connects the two circuits in parallel and, in the second case, in series. Intermediate positions are also possible, in which continuously only a more or less large share of the medium delivered by the pump according to the invention flows from the primary circuit into the secondary circuit, and vice versa. In all cases, the delivery demanded from the pump in the invention is at least approximately constant; when they are connected in parallel, each of the two impellers operates in one of the two circuits which are interconnected by the pump; when they are connected in series, one of the impellers operates in the flow line and the other impeller in the return line of a combined circuit with primary and secondary portion having correspondingly larger pressure losses, which are jointly overcome by the two impellers in series. The drive motor of the pump in the invention therefore always consumes at least approximately the same power and consequently can always operate with high efficiency. Irrespective of the position of the impellers in the pump in the invention, the flow velocities in the circuits are always at least approximately the same, so that objectionable noise can be largely avoided. As long as the pump or the blower is running, full circulation of the medium in both circuits is maintained, irrespective of the position of the impellers. In this way, localized overcooling and overheating is prevented.

In the case of sizeable heating or air-conditioning systems, a primary circuit is generally connected to a plurality of secondary circuits. If a pump or blower according to the invention is arranged in each case at the connecting points, the separate pumps customarily used in the primary circuit can then be dispensed with, whereby savings are made on the cost of installation and on the power requirement for the primary circuit.

It is convenient to use a tandem method of construction for the pump or blower in the invention, in which case the two impellers are arranged coaxially and rigidly interconnected with their suction sides on opposite sides. With this arrangement particularly simple machine elements suffice to obtain joint rotation and axial displacement of both impellers. Likewise, a drive motor common to both impellers can be arranged between them. The drive motor can be an outside-rotor motor having a stator fastened to a rod displaceable along the axis of the impellers, on which rod the two impellers rotate.

It is also convenient if each of the two impellers has a collar, with which it alternatively covers or uncovers, entirely or partially, one of the associated ducts. Besides, the drive motor can be surrounded by a collar common to both impellers.

In one embodiment of the subject matter of the invention as a centrifugal pump or centrifugal blower, the delivery flows of liquid or gas can be particularly accurately metered, if at least one of the two impellers for the separate supply of the separate ducts leading to one pressure stub pipe in each case is divided in at least one plane perpendicular to the axis by a ring disc.

Figure 1A:
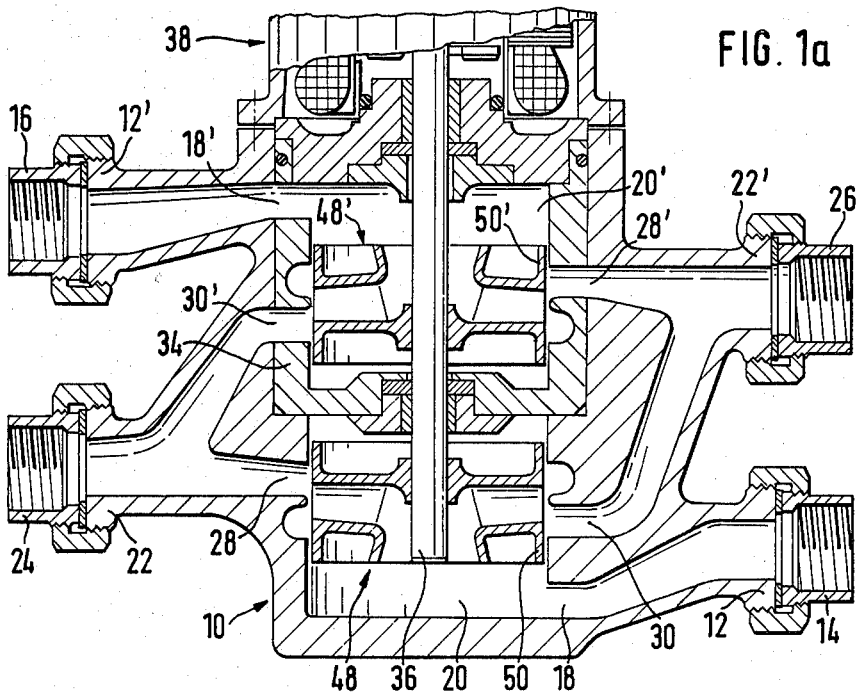
Figure 1B:
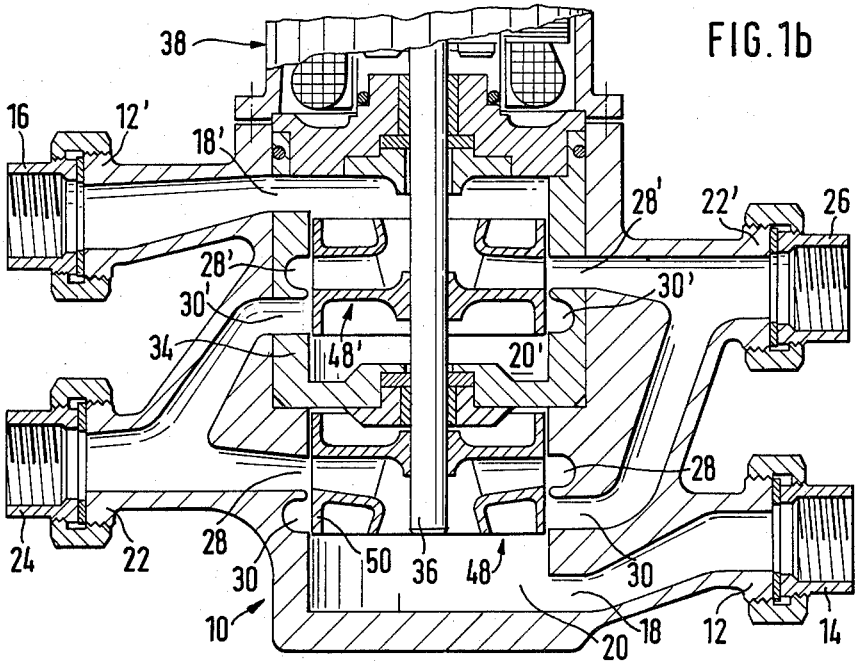
Figure 2:
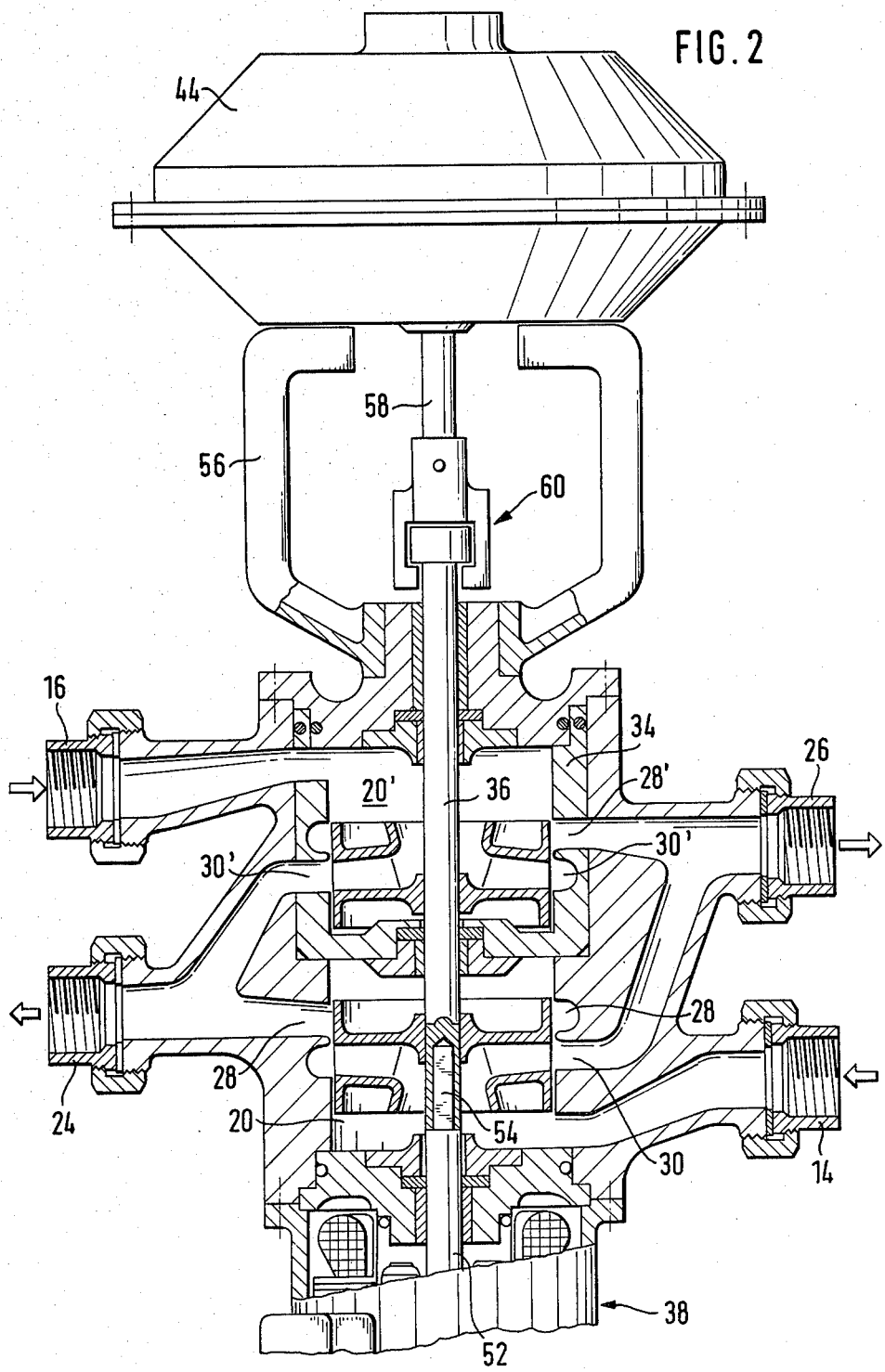
Figure 3:
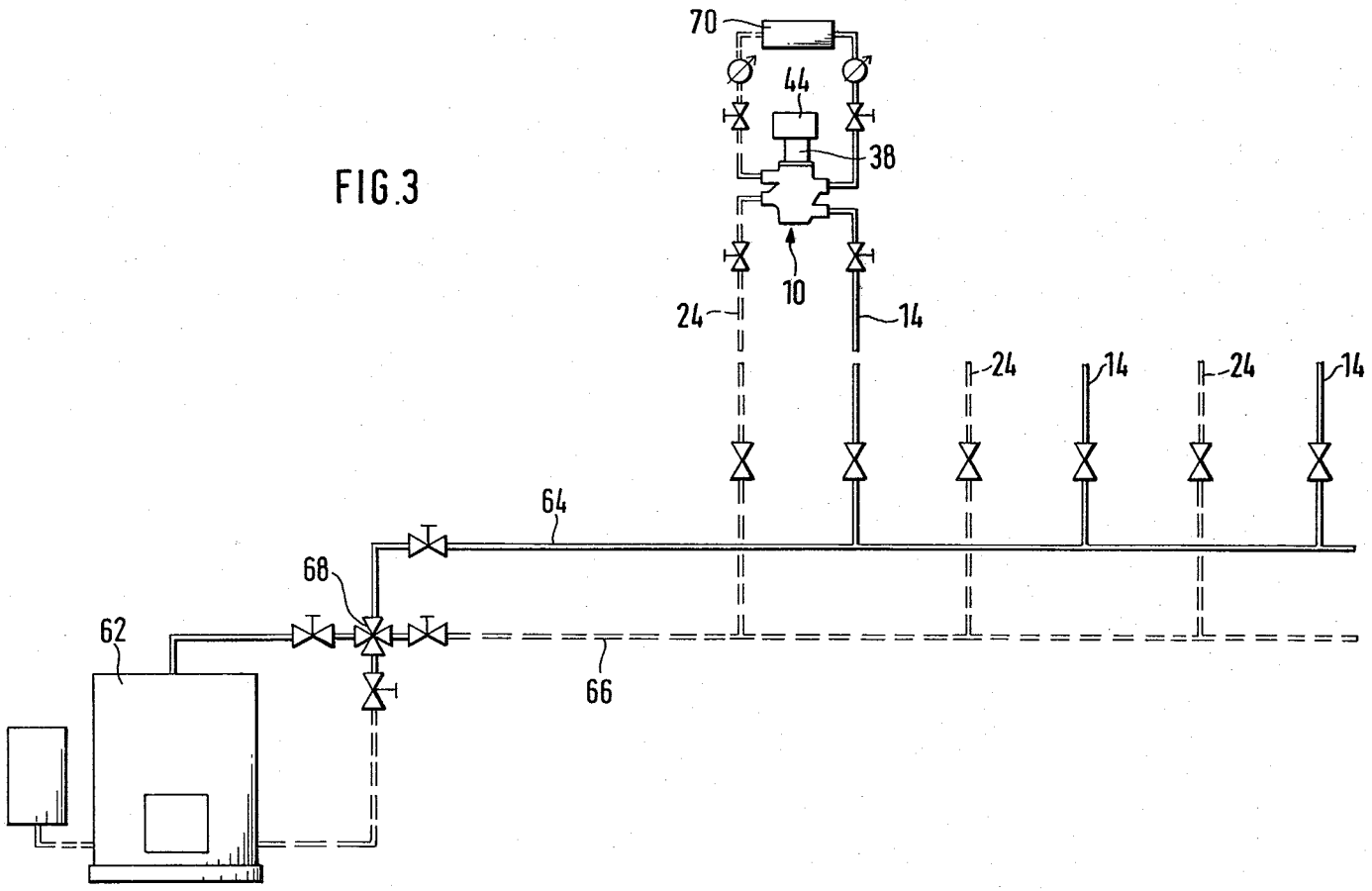
Figure 4:
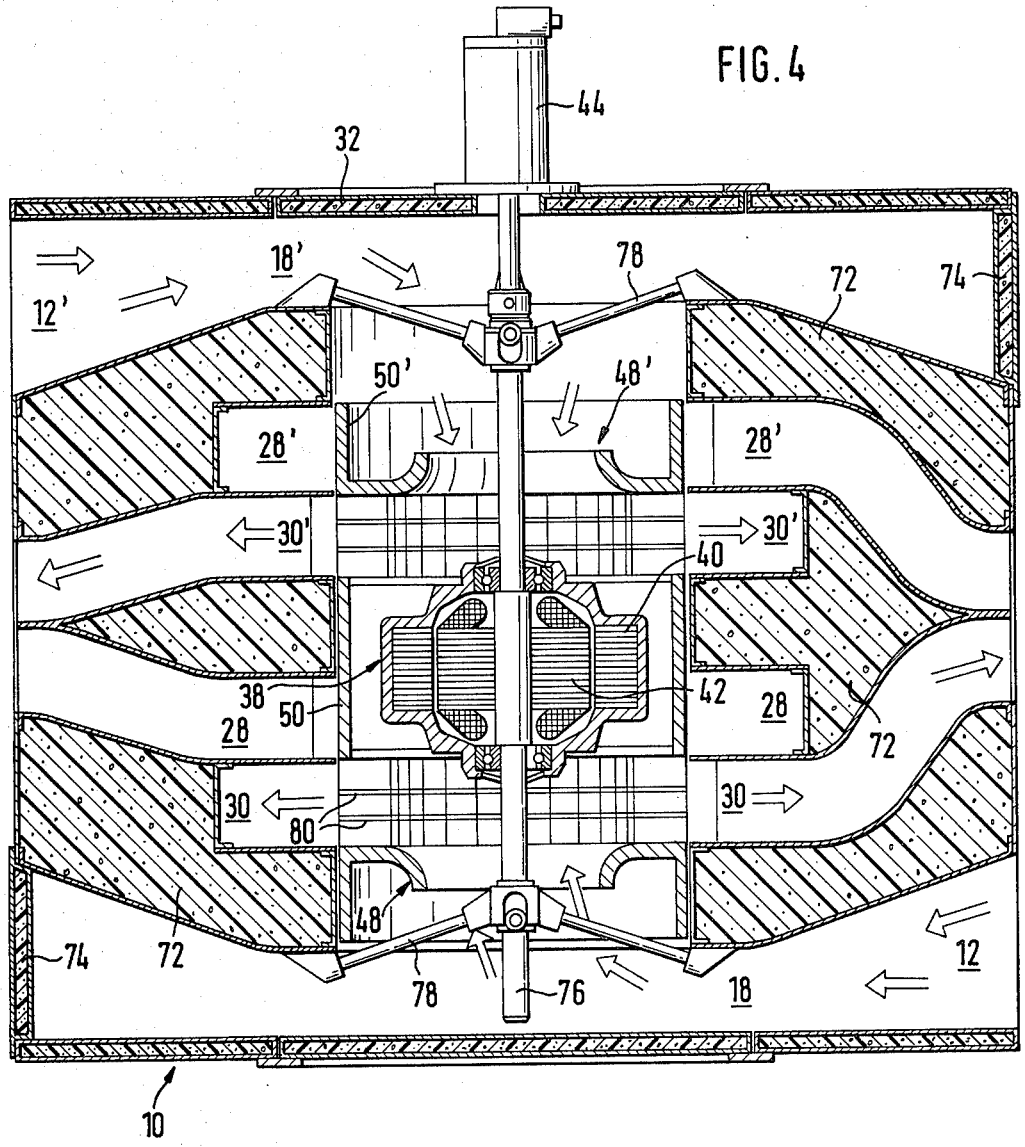
Figure 5:
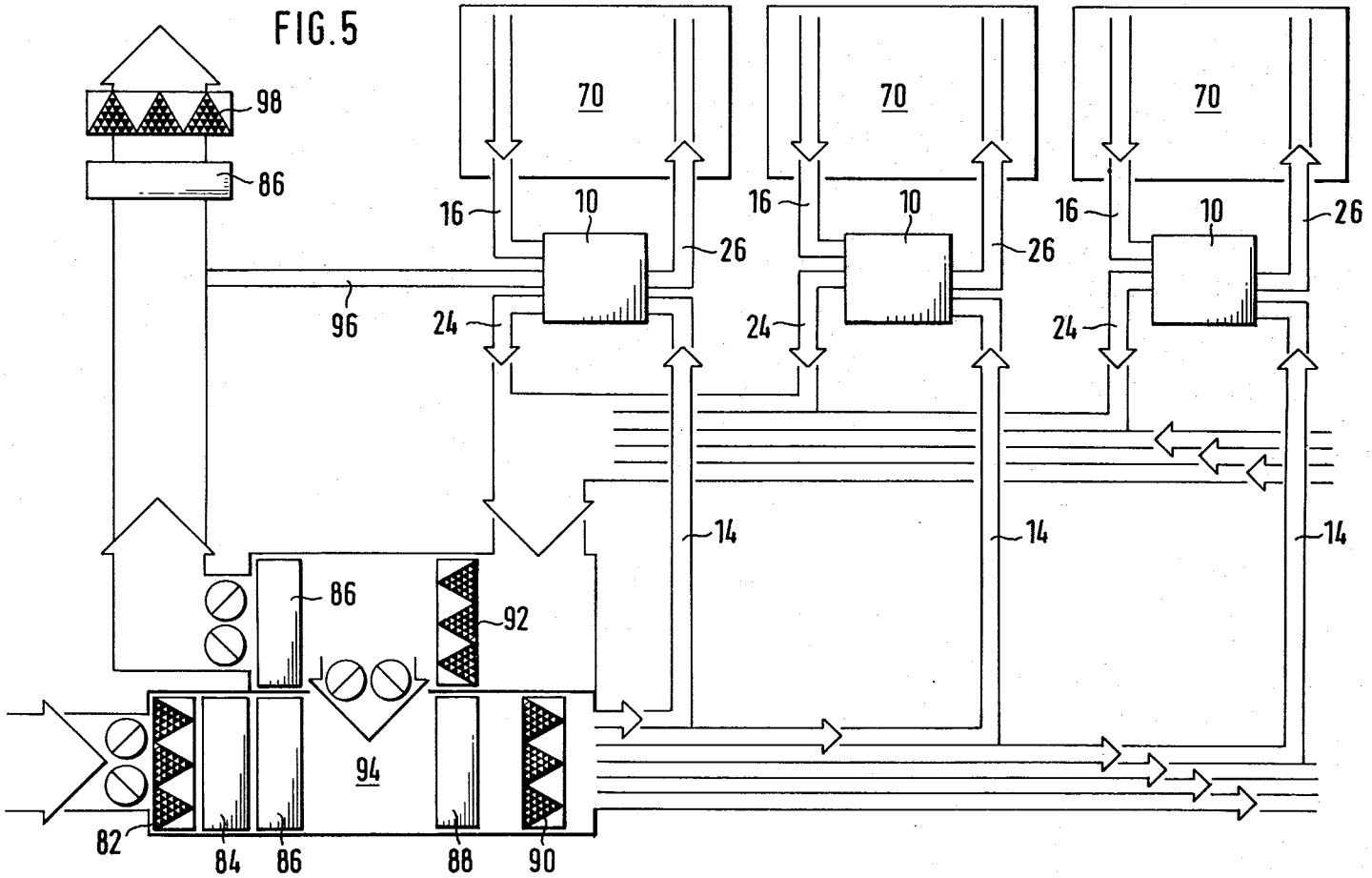

Examples of embodiments of the invention are described below with the help of schematic drawings. What is shown is in FIG. 1 an axial section through a pump according to the invention for a hot-water heating system, with the impellers in a position for maximum heating output obtainable;

FIG. 1*a* the same pump with the impellers in an intermediate position;

FIG. 1*b* the same pump with the impellers in a position for bypass operation;

FIG. 2 a variant of FIG. 1, likewise with the impellers in a position for maximum heating output obtainable;

FIG. 3 the arrangement of a pump as in FIG. 1 to 1*b* in a hot-water heating system;

FIG. 4 a blower according to the invention for an air-conditioning system, with the impellers in a position for maximum heating or cooling output obtainable and FIG. 5 the arrangement of a plurality of blowers as in FIG. 4 in an air-conditioning system.

The pump shown in FIGS. 1, 1*a* and 1*b* has a casing 10 with two suction stub pipes 12 and 12′ for a primary flow line 14 and a secondary return line 16, respectively. There is a suction duct 18 and 18′ connecting respectively each of the two suction stub pipes 12 and 12′ with one impeller chamber 20 and 20′ in each case formed in the casing 10.

The casing 10 also has two pressure stub pipes 22 and 22′ for a primary return line 24 and a secondary flow line 26, respectively. The impeller chamber 20 is connected via a first pressure duct 28 with the pressure stub pipe 22 and via a second pressure duct 30 with the pressure stub pipe 22′. Correspondingly, the impeller chamber 20′ is connected via a first pressure duct 28′ with the pressure stub pipe 22′ and via a second pressure duct 30′ with the pressure stub pipe 22.

The casing 10 has a cover plate 32 at the top and contains a receptacle 34 held by the latter, inside which receptacle the impeller chamber 20′ is formed. The impeller chamber 20 is directly formed inside the casing 10 and closed at the top by the bottom of the receptacle 34. An axially displaceable shaft 36 is mounted in the cover plate 32 and the bottom of the receptacle 34 and is sealed. The shaft 36 extends through an electric motor 38, which is flanged to the casing 10. The rotor 40 of the electric motor 38 is connected to rotate together with the shaft 36 but allows the latter to be displaced axially; the stator 42 of the electric motor is stationary. An hydraulic lifting device 44 fastened to the electric motor 38 is provided to shift the shaft 36.

Fastened to the shaft 36 there are two impellers 48 and 48′ the first of which is arranged to be axially displaceable within the impeller chamber 20 and the second within the impeller chamber 20′. The two impellers 48 and 48′ are largely of the conventional design for radial impellers of centrifugal pumps, i.e., they are configured so that they suck in the flow medium axially and deliver it radially outwards. In the illustrated arrangement, the suction sides of the two impellers 48 and 48′ are on opposite sides. In this way, the axial thrusts generated by the two impellers in service balance each other out, as the two impellers are fully identical in their dimensions and also always operate under largely the same conditions. Each of the impellers 48 and 48′ has a cylindrical collar, 50 and 50′ respectively, formed on its outer perimeter; with this collar, the impellers 48 and 48′ cover, entirely or partially, the one or the other associated pressure duct 28 or 30, and 28′ or 30′ respectively, depending on the axial position of the shaft 36.

In FIG. 1, the shaft 36 together with impellers 48 and 48′ is shown in a position in which the pressure ducts 28 and 28′ are entirely covered by the collars 50 and 50′, whereas the pressure ducts 30 are entirely open. Consequently, flow water from the primary flow line 14 is sucked in via the suction stub pipe 12, the suction duct 18 and the impeller chamber 20 by the impeller 48, and the entire quantity of water sucked in by this impeller 48 is pumped through the pressure duct 30 and the pressure stub pipe 22′ into the secondary flow line 26, whereas return water from the secondary return line 16 is sucked in by the impeller 48′ via the suction stub pipe 12′, the suction duct 18′ and the impeller chamber 20′ and pumped via the pressure duct 30′ and the pressure stub pipe 22 into the primary return line 24. With the setting shown in FIG. 1, the maximum obtainable heating output is thus available.

With the shaft 36 together with impellers 48 and 48′ shown in the position in FIG. 1*a*, only roughly one half of the water sucked in from the primary flow line 14 goes into the secondary flow line 26; the other half is delivered back by the impeller 48 via the pressure duct 28 and the pressure stub pipe 22 into the primary return line 24, without having reached a consumer. Correspondingly, now only half of the water sucked in from the secondary return line 16 is delivered by the impeller 48′ into the primary return line 24, whereas the other half is delivered back by the impeller 48′ via the pressure duct 28 and the pressure stub pipe 22′ into the secondary flow line 26. Despite the shifted position of impellers 48 and 48′, the flow conditions are at least approximately just as good as in the position in FIG. 1, as in each case both pressure ducts 28 and 30, or 28′ and 30′ respectively, are located in close proximity in an axial direction and have the same shape and dimensions, namely are of spiral configuration customary for centrifugal pumps.

FIG. 1*b* shows the complete reversal of the conditions illustrated in FIG. 1. In this case, the shaft 36 together with impellers 48 and 48′ is in a position in which the entire quantity of water sucked in by impeller 48 from the primary flow line 14 is delivered via pressure duct 48 into primary return line 24, while the entire quantity of water sucked in by impeller 48′ from the secondary return line 16 is delivered back via pressure duct 28' into the secondary flow line 26. Thus, no heating output is offered to the secondary circuit in this position.

The embodiment shown in FIG. 2 differs from that in FIG. 1 in that the electric motor 38 is flanged on to the underside of the casing 10 and has a shaft 52 mounted to be non-displaceable separate from the axially displaceable shaft 36, which it drives via a sliding coupling 54. The lifting device 44 in this case is constructed as a pneumatic one, is fastened via a U-shaped support 56 to the top of the casing 10 and is equipped with a non-rotatable lifting rod 58, which is connected to the shaft 36 by means of lifting coupling 60.

The heating system shown schematically in FIG. 3 is equipped with a plurality of pumps as shown in FIG. 1. Belonging to the heating system there is a boiler 62, starting out from which there is a primary main flow line 64 and to which a primary main return line 66 leads back via a four-way valve 68. A plurality of primary flow lines 14 branch off from the primary main flow line 64 as risers; a corresponding number of primary return lines 24 lead back into the primary main return line 66. The pumps, viz., each one of them, as have been described in detail in the foregoing, supplies one or more consumers 70. Whereas, in the case of customary hot-water heating systems—each of the secondry circuits of which contains a multi-way mixing valve and a circulating pump of conventional design—a circulating pump of appropriately high rating must be provided in the primary main flow line, such a latter pump is not required in the heating system in FIG. 3, as the pumps shown in detail in FIGS. 1 and 2 are themselves capable of supplying their associated secondary circuits with hot water from the boiler 62.

The blower shown in FIG. 4 is a centrifugal blower with a basic design corresponding to the cenntrifugal pump in FIG. 1, for which reason the same reference numbers are used in FIG. 4 as in FIG. 1 for corresponding parts. The casing 10 in FIG. 4 is of thin sheet metal and has cavities 72 which are filled with foamed material, for instance with polyurethane foam. The casing 10 has two suction stub pipes 12 for a not illustrated primary feed-air line, as well as two suction stub pipes 12' for a likewise not illustrated secondary-circuit return-air line. Of these suction stub pipes 12 and 12', one in each case is closed by a cover 74. Instead of the shaft 36, an axially displaceable but non-rotatable rod 76 passes through the casing 10 and the two impellers 48 and 48' without making direct contact with them at any point. The displaceable rod 76 is guided by spokes 78 radiating to and attached to the casing 10. The electric motor 38 is an outside-rotor motor with a rotor 40 pivoted to rotate on the rod 76 in such a manner that it takes part in axial displacements of the rod 76. The stator 42 of the electric motor 38 is on the inside and is fastened to the rod 76.

The two impellers 48 and 48' are fastened directly to the outside rotor 40 in such a manner that the entire electric motor 38 is between the impellers 48 and 48' and surrounded by their collars 50.

As in the case of the pump in FIGS. 1, 1*a* and 1*b*, as well as of the variant of same in FIG. 2, the two impellers 48 and 48' of the blower in FIG. 4 can be jointly moved in an axial direction; movement upwards from the position illustrated in FIG. 4 has effects corresponding to those which have been described with the aid of FIGS. 1, 1*a* and 1*b*. In order to obtain a flow distribution to the pressure ducts 28 and 30, as well as to 28' and 30', matching as closely as possible the selected axial position of the impellers 48, 48', each of the impellers 48 and 48' has two ring discs 80 in planes perpendicular to the axis, as shown in FIG. 4, said discs dividing up the flow ducts between the vanes of the impellers in each case into three parallel partial ducts.

In the air-conditioning system illustrated in FIG. 5, a plurality of blowers according to FIG. 4 are arranged as controlled intermediary members between a primary circuit 14, 24 in each case and a secondary circuit 16, 26 in each case. This air-conditioning system also has a fresh-air filter 82, a cooler 84, a heat recuperator 86, a reheater 88, a fine filter 90, a return-air filter 92 and a return-air admixture chamber 94. Blowers are not required in the zone where this equipment is; as in the case of the heating system in FIG. 3, it suffices if the air-conditioning system in FIG. 5 has blowers of the design illustrated in FIG. 4 for the flows required both in the primary circuits 14, 24 and in the secondary circuits 16, 26.

In the case of the casing 10 of the blower shown on the left in FIG. 5, the pressure ducts 28 and 30' routed separately to the outside are also separate from each other outside the casing 10. In like manner to the pump in FIGS. 1, 1*a*, 1*b* and 2, a primary return-air duct 24 is connected up to pressure duct 28. On the other hand, an exhaust-air duct 96 leading via a heat recuperator 86 and an exhaust-air filter 98 to the open air is connected up to the pressure duct 30'.

Thus, the return air coming in FIG. 5 from the left-hand consumer 70, for instance an isolation ward at a hospital, under no circumstances gets back into a primary circuit, so that the risks of contamination and infection are avoided.

What I claim is:

1. A pump or blower, in particular for heating and air-conditioning systems, comprising:

(a) a casing, said casing having
- i. a primary impeller chamber;
- ii. a secondary impeller chamber;
- iii. a primary suction duct constantly connected to said primary impeller chamber;
- iv. first and second primary pressure ducts adapted for connection to said primary impeller chamber;
- v. a secondary suction duct constantly connected to said secondary impeller chamber;
- vi. first and second seconary pressure ducts adapted for connection to said secondary impeller chamber;
- vii. said second primary pressure duct being constantly connected to said first primary pressure duct;

(b) a pair of impellers mounted on a common shaft in said casing, said pair of impellers comprising:
- i. a primary impeller in said primary impeller chamber; and
- ii. a secondary impeller in said secondary impeller chamber; and (c) shifting means for shifting said pair of impellers between
- i. a first end position in which said primary impeller connects said primary impeller chamber only to said first primary pressure duct and wherein said secondary impeller connects said secondary impeller chamber only to said first secondary pressure duct and
- ii. a second end position in which said primary impeller connects said primary impeller chamber only to said secondary primary pressure duct and wherein said secondary impeller connects said secondary impeller chamber only to said secondary pressure duct.

2. The pump or blower as in claim 1 wherein the pair of impellers are arranged coaxially and rigidly interconnected with their suction sides on opposite sides.

3. The pump or blower as in claim 2, wherein a drive motor common to both impellers is arranged between them.

4. The pump or blower as in claim 3, wherein the drive motor is an outside-rotor motor having a stator fastened to a rod displaceable along the axis of the impellers and on which rod the two impellers rotate.

5. The pump or blower of claim 1 wherein each of the two impellers has a collar with which it selectively covers, at least partially, one of the associated ducts.

6. The pump or blower as in claim 5, wherein a drive motor common to both impellers is disposed between them and is surrounded by a collar common to both impellers.

7. The pump or blower of claim 1 wherein at least one of the impellers has a ring disc disposed in at least one plane perpendicular to the axis.

8. The pump or blower as claimed in claim 1 wherein said shifting means is operative to hold said pair of impellers in at least one intermediate position wherein i. said primary impeller connects said primary impeller chamber to both said first and second primary pressure ducts and ii. said secondary impeller connects said secondary impeller chamber to both said first and second secondary pressure ducts.

* * * * *